United States Patent [19]

Hobgood

[11] 4,174,231

[45] Nov. 13, 1979

[54] METHOD FOR FLUSHING THE CRANKCASE OF AN INTERNAL COMBUSTION ENGINE

[76] Inventor: Harold G. Hobgood, 620 Spruce St., Newport News, Va. 23601

[21] Appl. No.: 831,685

[22] Filed: Sep. 8, 1977

[51] Int. Cl.[2] ..... B08B 3/08

[52] U.S. Cl. ..... 134/10; 134/22 R; 134/34; 134/39; 134/40

[58] Field of Search ..... 134/22 R, 34, 39, 40, 134/166 R, 169 A, 10; 184/1.5; 123/198 R, 198 A; 220/304; 210/DIG. 17

[56] References Cited

U.S. PATENT DOCUMENTS

| | | | |
|---|---|---|---|
| 1,696,100 | 12/1928 | Osborne | 184/1.5 |
| 3,260,367 | 7/1966 | Hultgren | 210/DIG. 17 |
| 3,282,429 | 11/1966 | Wood et al. | 210/DIG. 17 |
| 3,333,703 | 8/1967 | Scavuzzo et al. | 210/DIG. 17 |
| 3,489,245 | 1/1970 | Broadwell | 184/1.5 |
| 3,773,180 | 11/1973 | Harrison | 210/DIG. 17 |

*Primary Examiner*—Marc L. Caroff

*Attorney, Agent, or Firm*—Mason, Fenwick & Lawrence

[57] ABSTRACT

A method of flushing the crankcase of an internal combustion engine includes the steps of draining the engine crankcase, removing the old filter and cartridge and replacing it with a fitting which consists of a hollow housing mountable on the oil filter mounting means of the engine. The crankcase is filled with flushing liquid and the engine is operated to effect circulation of the flushing fluid in the engine and through the fitting without filtration; the engine is then stopped and the crankcase drained, the fitting removed and replaced with a clean oil filter cartridge and the crankcase filled with clean oil.

1 Claim, 4 Drawing Figures

METHOD FOR FLUSHING THE CRANKCASE OF AN INTERNAL COMBUSTION ENGINE

This invention is in the field of four-cycle internal combustion engines and is more particularly directed to means for enabling the cleaning of the engine lubrication system of such an engine by flushing the crankcase to remove contaminants therefrom.

It is the usual practice to change the oil and filter in a four-cycle internal combustion engine by simply draining the crankcase, replacing the filter cartridge and filling the crankcase with clean oil. This simple draining of the dirty oil, while obviously beneficial as compared to leaving the dirty oil in the crankcase, does not result in the removal of all of the contaminants and sludge materials which build up in the crankcase and consequently provides results far inferior to those achieved by a flushing operation in which the crankcase and lubricated internal engine components are thoroughly washed by flushing liquid to effect a removal of the contaminants.

While there have been a number of devices proposed for use in the flushing of four-cycle engine crankcases, such devices have suffered from a number of drawbacks such as being overly complicated, cumbersome and expensive to manufacture, use and operate. Consequently, engine flushing operations have usually been performed by the employment of one of two methods neither of which requires the employment of extensive external equipment and unfortunately neither of which provides fully satisfactory results.

In the first known method, which could be fairly referred to as the dirty filter method, the engine crankcase is initially drained of oil and flushing fluid is introduced into the crankcase. The flushing fluid can be of any conventional type such as two quarts of kerosene and two quarts of twenty-weight oil and the engine is permitted to idle for approximately five minutes with the flushing fluid in the crankcase. Idling operation of the engine effects a pumping of the flushing fluid through the engine which is desirable; unfortunately the flushing liquid is also pumped through the dirty filter cartridge. Consequently, since the filter cartridge contains many contaminants, the passage of the filter fluid through the cartridge serves to greatly contaminate the flushing fluid to circulate it throughout the entire oil system and a residue of contaminants is left in the engine when the flushing fluid is drained from the engine.

In the second conventional method, which is referred to as the new filter method, the dirty oil is drained from the crankcase and the dirty oil filter is removed and replaced with a new, or sacrificial, filter. The crankcase is filled with the flushing fluid and operated with the engine idling for approximately five minutes in the manner of the first method. The crankcase is then drained and the new, but now dirty, filter is removed and replaced with a clean filter. While the results of this procedure are substantially better than the dirty filter method, it is more expensive due to the need for employing two new filters.

Therefore, there has been a continuing need for providing a functionally effective, yet inexpensive, engine flushing operation not requiring the use of expensive or complicated auxiliary equipment.

Therefore, it is the primary object of this invention to provide a new and improved apparatus and method for flushing the crankcase of four-cycle internal combustion engines.

Achievement of the foregoing objects is enabled by the preferred embodiment of this invention which consists of an adaptor consisting of a hollow housing in the shape of an oil filter cartridge provided with a threaded aperture and sealing means on one end essentially identical to that of a conventional filter cartridge permitting the housing to be connected to the oil filter mounting fitting of an internal combustion engine. The flushing permitting adaptor is mounted on the engine following draining of the crankcase and the crankcase is then filled with the flushing fluid and operated at idle for approximately five minutes. Operation of the engine causes the flushing fluid to be passed directly through the adaptor to provide a thorough washing of the engine components in a manner which achieves results fully as good as those achieved with the use of a new filter and far superior to the results achieved by the old filter method. Moreover, the adaptor is reusable and its use consequently results in substantial savings as compared to the new filter method of crankcase cleaning.

A better understanding of the inventive apparatus and method will be achieved when the following written description is considered in conjunction with the appended drawings in which.

Figure 1:
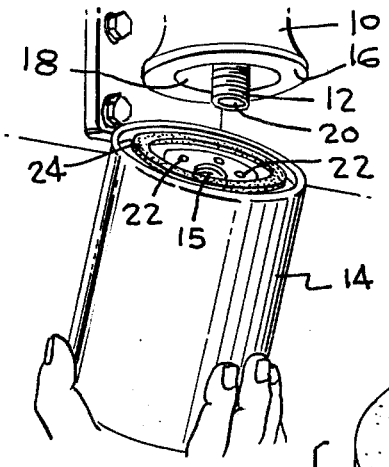
FIG. 1 is a perspective view illustrating removal of the dirty oil filter from the oil filter cartridge mounting means on a four-cycle internal combustion engine as an initial step in the inventive method.

Attention is initially invited to FIG. 1 of the drawings which illustrates a conventional oil filter cartridge mounting attachment or fitting 10 provided on the block of a four-cycle internal combustion engine and including a threaded pipe or nipple 12 which is engaged with the internal threads 15 of an oil filter cartridge 14. The filter mounting fitting means 10 consists of an outer housing having a flat lower sealing surface 16 surrounding an annular shaped outflow opening 18 from which oil is normally pumped by the oil pump of the engine. The threaded pipe or nipple member 12 is axially positioned within the annular shaped outflow opening 18 and has an internal inflow passageway 20 into which filtered oil from the filter cartridge 14 is normally directed during operation of the engine. The filter cartridge 14 includes a plurality of openings 22 into which the oil from the outflow opening 18 is directed for passage into the housing of the cartridge and through filter means (not shown) on the interior of the housing to be returned through the threaded opening 15 and threaded pipe or nipple 12 to the engine in a well-known manner. Additionally, the upper end of the filter cartridge includes an annular sealing member 24 engageable with the downwardly facing flat lower sealing surface 16 of the mounting attachment or fitting 10.

Figure 3:
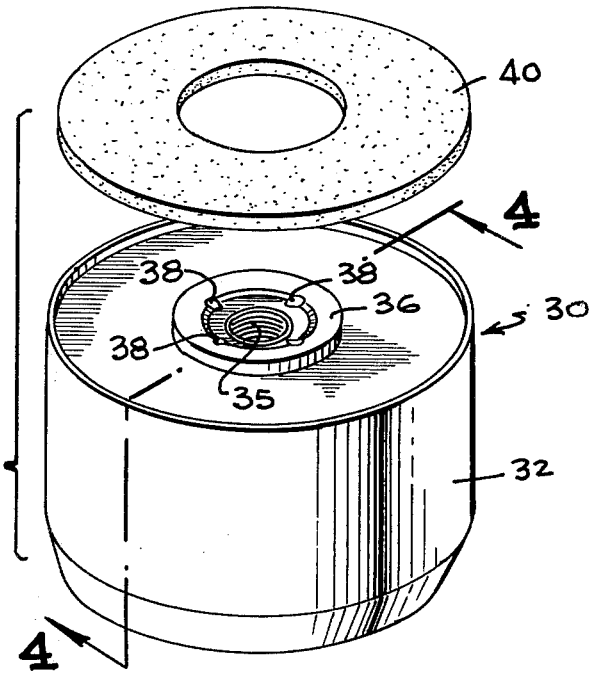
FIG. 3 is an exploded perspective view of the inventive device.

FIG. 3 illustrates the preferred embodiment for practice of the invention, which consists of an adaptor generally designated 30, which is mountable on the mounting attachment or fitting 10 of the internal combustion engine in the same manner as cartridge 14. However, the preferred embodiment comprises a hollow housing 32 which does not have any filtering means on its interior and the sole function of which is to return the oil from outflow opening 18 to inflow opening 20.

To achieve the foregoing purpose, adaptor fitting 30 includes an end wall 34 mounted in the housing 32 and which is in the form of a metal disc including an axial passageway the periphery of which is defined by threaded surface 35. A raised annular rib 36 extends outwardly in an axial direction from the end wall forming disc 34 with a plurality of openings 38 being provided inwardly of the raised annular rib 36. The opening defined by threaded surface 35 is of the same size as the opening 15 of the oil filter cartridge and the openings 38 are in the same positions as the openings 22 of the oil filter cartridge. An annular sealing disc formed of rubber or the like is positioned radially outward of the raised annular rib 36. Consequently, the sealing disc is engageable with the surface 16 in the same manner as the sealing means 24 of the cartridge.

Figure 4:
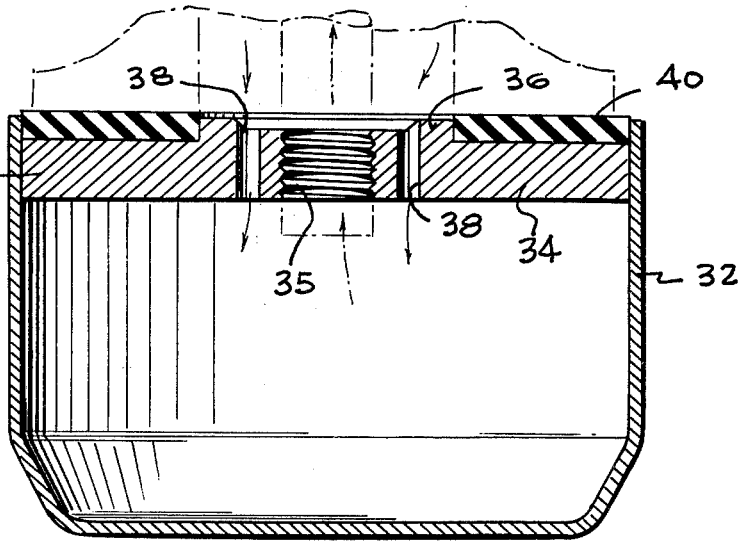
FIG. 4 is a sectional view taken along lines 4—4 of FIG. 3.

The fitting 30 is positionable on the mounting attachment 10 in exactly the same manner as the oil filter cartridge 14 so that operation of the engine will effect the pumping of fluid from the crankcase downwardly from the annular shaped outflow opening 18 through the openings 38 for return to the engine via the threaded opening 35 and the pipe or nipple 12. However, it will be apparent from FIG. 4 that such operation does not result in any filtration of the liquid and the fitting 30 merely serves to direct the fluid back into the engine sump.

Figure 2:
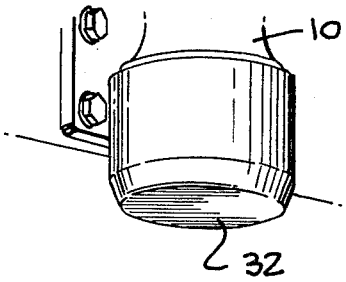
FIG. 2 is a perspective view illustrating the inventive apparatus mounted on the four-cycle engine in place of an oil filter.

Practice of the inventive method is simply effected by initially removing the conventional oil filter cartridge 14 as shown in FIG. 1 and replacing the oil filter cartridge by the inventive coupling 30 as shown in FIG. 2. The dirty crankcase oil is drained from the crankcase and the crankcase is filled with flushing liquid. The engine is then operated for several minutes during which the flushing liquid flows downwardly into the fitting 30 and is immediately returned to the crankcase via the opening defined by threads 35 and the pipe 12. Consequently, the internal engine components are thoroughly cleaned.

Upon completion of the cleaning operation, the engine is stopped and the fitting 30 removed from the mounting means 10 and a new oil filter is placed in position on the mounting means. The flushing fluid is drained and the crankcase is then filled with new lubricating oil. This operation provides a complete cleaning of the lubrication system that is much more effective than the older "dirty filter" cleaning method. Since fitting 30 can be reused, the cost of the cleaning operation is essentially no more than that of the "dirty filter" method; however, the inventive method provides results fully equal to those achieved by the use of the "new filter" cleaning method while avoiding the additional cost of the sacrificial oil filter required in the "new filter" cleaning method.

Numerous modifications of the subject invention will undoubtedly occur to those of skill in the art and it should therefore be understood that the spirit and scope of the invention is to be limited solely by the appended claims.

I claim:

1. A method of flushing with a liquid the crankcase of an internal combustion engine of the type having a spin-on oil filter cartridge fitting including an outflow opening, an inflow opening and a threaded pipe portion on which a spin-on oil filter cartridge is removably mounted, said method comprising the steps of draining the engine crankcase of any fluids contained therein, removing said spin-on filter cartridge, placing said flushing liquid in the crankcase, operating the engine to effect circulation of the flushing liquid in the engine to cause flow of the flushing liquid from said outflow opening and immediately returning said flushing liquid flowing from the outflow opening to the inflow opening of said engine without passing said flushing liquid through filtration means.

* * * * *